United States Patent [19]

Gumushan, deceased et al.

[11] 4,183,364

[45] Jan. 15, 1980

[54] TOBACCO REFINING PROCESS

[76] Inventors: Osman H. Gumushan, deceased, late of Istanbul, Turkey; by Hatice Gumushan, administrator, Cad Garanti Han Kat 8 Daire 31, Harbiye Halaskargi, Turkey

[21] Appl. No.: 749,959

[22] Filed: Dec. 7, 1976

[51] Int. Cl.[2] ..... A24B 15/02

[52] U.S. Cl. ..... 131/143

[58] Field of Search ..... 131/143, 140 R, 17, 131/15, 140 L; 260/291; 426/429, 430

[56] References Cited

U.S. PATENT DOCUMENTS

| | | | |
|---|---|---|---|
| 1,294,310 | 2/1919 | Sayre | 131/143 |
| 2,170,107 | 8/1939 | Baier | 131/142 A |
| 3,046,997 | 7/1962 | Hind | 131/143 |
| 3,353,541 | 11/1967 | Hind et al. | 131/140 C |
| 3,860,012 | 1/1974 | Selke | 131/143 |
| 3,995,646 | 12/1976 | DeBrunn et al. | 131/143 |

*Primary Examiner*—Vincent Millin

*Attorney, Agent, or Firm*—Howard I. Podell

[57] ABSTRACT

A process for refining tobacco for cigarette use so that the end product is free of resin and tar and virtually free of nicotine, which affords economics in the processing procedure. The tobacco is initially steeped in a hot solution of Potassium Metabisulfite ($K_2S_2O_5$) or Potassium Sulphate ($K_2SO_4$) and then boiled in a solution of Potassium Sulfate and Potassium Nitrate. The tobacco is then air dried and sprayed with flavoring material.

3 Claims, 1 Drawing Figure

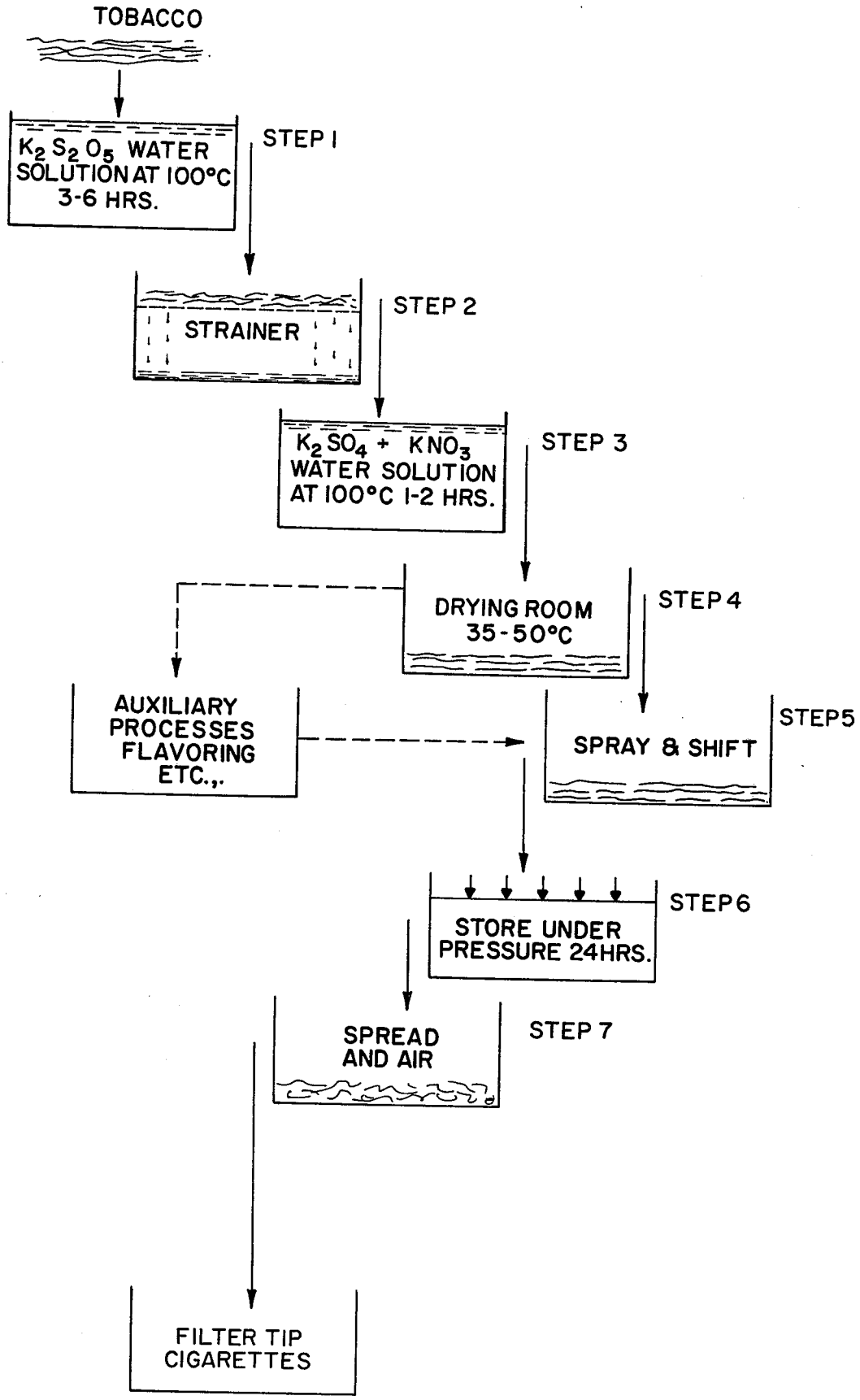
TOBACCO
$K_2S_2O_5$ WATER SOLUTION AT 100°C 3-6 HRS.
STEP 1
STRAINER
STEP 2
$K_2SO_4$ + $KNO_3$ WATER SOLUTION AT 100°C 1-2 HRS.
STEP 3
DRYING ROOM 35-50°C
STEP 4
AUXILIARY PROCESSES FLAVORING ETC.,.
SPRAY & SHIFT
STEP5
STORE UNDER PRESSURE 24HRS.
STEP6
SPREAD AND AIR
STEP 7
FILTER TIP CIGARETTES

TOBACCO REFINING PROCESS

SUMMARY OF THE INVENTION

My invention relates to a refining process for removing tar, resin and nicotine from tobacco and particularly to a process for producing such tobacco for cigarette use.

The tobacco is initially steeped in a hot aqueous dilute solution of Potassium Metabisulfite ($K_2S_2O_5$) or Potassium Sulfate ($K_2SO_4$) at a temperature of 55 centigrade to 70 centigrade and then boiled for one to three hours in a solution of 1%-3% Potassium Sulfate ($K_2SO_4$) and 1%-3% Potassium Nitrate ($KNO_3$). The solution is then extracted from the tobacco and the tobacco is then air dried at a temperature of 35 centigrade to 45 centigrade and sprayed with flavoring material.

The prime advantage of the process is the removal of the cancer-causing chemicals tar and nicotine from the tobacco.

Several economic advantages accrue from the use of this process:

1. Age-curing the tobacco is not required.
2. Quality classification of the tobacco leaves is not required.
3. Mold causing bacteria which damages the tobacco is eliminated.
4. All the tobacco harvested can be used including broken bits and pieces.

BRIEF DESCRIPTION OF THE DRAWING

The drawing is a flow chart of the process of the invention.

DESCRIPTION OF THE PREFERRED EMBODIMENT

Turning now descriptively to the drawing which is a flow chart of the process, the following are the steps of the refining process, with solution concentrations reported in terms of weight:

Step 1

The newly harvested tobacco, having been shredded to pieces ranging from one to two mm. in length, is immersed in an aqueous bath of 0.1% to 0.3% Potassium Metabisulfite solution ($K_2S_2O_5+H_2O$) for a period of three to six hours, at a temperature of 100 centigrade.

Step 2

The solution is strained from the tobacco.

Step 3

The tobacco is then placed in an aqueous solution of 1%-3% of Potassium Sulfate ($K_2SO_4$) and 1%-3% of Potassium Nitrate ($KNO_3$), at a temperature close to the boiling point. The tobacco is boiled in this solution for one to three hours, with stirring. The tobacco is then strained from the solution, which retains the tar, nicotine and resin removed from the tobacco, and the solution is retained for preparation of products such as pesticides. The tobacco may be then rinsed with water.

Step 4

Upon removal from the solution the tobacco is then taken to a drying area where the air temperature is controlled between 35 centigrade and 50 centigrade. Here the moisture content of the tobacco is reduced to between 8 and 12 percent while the acid-alkali level of the tobacco is maintained between 5.5 and 7.5 on the PH scale.

In order to remove the contents of tar and nicotine from tobacco entirely, the tobacco is then softened by applying a mastication process and subsequently distilled with organic solvents such as petroleum ether, "ligroin" (low or high boiling), or benzene in an industrial extraction device such as a Sokhles Unit. The resulting tobacco, free from nicotine, recine and tar contents, is dried in open air under a temperature of 25-45 centigrade. To accelerate the drying process, air or steam vapor of 105-125 centigrade may be sprayed into the chamber containing the tobacco.

Step 5

The tobacco is now placed on a clean floor protected from the wind. Desired liquid flavorings and moderating agents are sprayed over and through the tobacco. A list of suitable additives includes:

Blender TVO
Burley Flavor
Cardomom Oil
Cumarin Solution
Fig Flavor
Fixatives
Honey Flavor
Maple Flavor
Menthol Flavor
Oriental Flavor
Peach Flavor
Rum Flavor
Rum Oil
Tonka Extract
All American Type Cigarette Flavor
Turkish Tobacco Flavor
Virginia Flavor
Molasses Extract
Resinoid
Arrack
Vine
Brandy
Carob Flavor
Universal Flavor
Glycerin Jelly
Alcohol
Gum Arabic
Potassium Nitrate Step 6

The tobacco is now stored for a period of twelve to twenty-four hours in thick wooden barrels or in aluminum-lined metal barrels. During this period the tobacco is compacted by applying a pressure of 150 to 250 kilograms per square decimeter (approximately 20-30 psi) externally to the barrel lid to compress the tobacco.

Step 7

After the above period of storage, the tobacco is again spread on a clean floor, where it is air dried for a period of ten to twenty-five minutes or until a small quantity of the dried tobacco, when compressed in the hand, springs back to its original form when released. The tobacco is shifted regularly during this airing process to ensure even drying. The processed tobacco, which is of a size suitable for the manufacture of cigarettes, is removed from the batch.

Tobacco processed in the described manner, when analyzed, was found to have no tar or resin content and between 0.01% and 0.02% nicotine.

An outside laboratory test performed by the Sezen Laboratories of Istanbul, Turkey reported on May 3, 1973, the following analysis of tobacco processed in accordance with the above steps: t,50

Since obvious changes may be made in the specific embodiment of the invention described herein, such modifications being within the spirit and scope of the invention claimed, it is indicated that all matter contained herein is intended as illustrative and not as limiting in scope.

I claim:

1. A refining process for eliminating tars and nicotine from tobacco comprising the steps of:

a. steeping fresh shredded tobacco in a hot dilute aqueous bath of 0.1% to 0.3% Potassium Metabisulfite solution ($K_2S_2O_5$) for a period of three to six hours and subquently extracting the solution from the tobacco, b. immersing the tobacco in a boiling aqueous solution of one to three percent gram ratio of Potassium Sulfate ($K_2SO_4$) and one to three percent gram ratio of Potassium Nitrate ($KNO_3$) for a period of one to three hours and subquently extracting the solution from the tobacco, c. drying the tobacco under a temperature ranging from thirty-five to fifty degrees centigrade.

2. The process as recited in claim 1 in which the tobacco is subsequently washed with an organic solvent which is then extracted from the tobacco, and the tobacco subsewuently dried in air at a temperature ranging from twenty-five to forty-five to forty-five degrees centigrade.

3. The process as recited in claim 2 in which the tobacco is compressed under a pressure of 150 to 250 kilograms per square decimeter for a period of twelve to twenty-four hours.

* * * * *